United States Patent [19]

Bodde

[11] 4,306,277

[45] Dec. 15, 1981

[54] FLASHLIGHT HAVING AN INSERTABLE PROBE CONTACT

[76] Inventor: Egbert J. Bodde, Rte. One, Trego, Wis. 54888

[21] Appl. No.: 95,234

[22] Filed: Nov. 19, 1979

[51] Int. Cl.[3] ..... F21L 7/00

[52] U.S. Cl. ..... 362/203; 362/120; 362/201; 362/206

[58] Field of Search ..... 362/120, 201, 203, 205, 362/206

[56] References Cited

U.S. PATENT DOCUMENTS

| | | | |
|---|---|---|---|
| 2,144,858 | 1/1939 | Smith | 362/203 |
| 2,534,709 | 12/1950 | Goertzen | 362/203 |
| 3,074,196 | 1/1963 | Bronson | 362/206 |
| 3,592,199 | 7/1971 | Ostensen | 362/206 |
| 3,742,207 | 6/1973 | Strauss | 362/206 |
| 4,183,076 | 1/1980 | Bodde | 362/120 |

*Primary Examiner*—Donald P. Walsh

*Attorney, Agent, or Firm*—Schroeder, Siegfried, Ryan, Vidas, Steffey & Arrett

[57] ABSTRACT

A flashlight having an insertable probe contact.

1 Claim, 5 Drawing Figures

FLASHLIGHT HAVING AN INSERTABLE PROBE CONTACT

DESCRIPTION

BACKGROUND OF THE INVENTION

This invention relates to a flashlight and relates, more particularly, to flashlights actuated by an insertable probe contact.

BRIEF SUMMARY OF THE INVENTION

In carrying out the preferred embodiment of the invention, a comparatively simple flashlight device is used. It is adapted according to the invention by the provision of an insertable probe contact means. In some embodiments, the flashlight is slidably and removably carried by the insertable probe contact. When the flashlight slides downwardly on the probe contact, the bulb is energized and lighted.

Various objects, features, and advantages of the invention will be readily apparent from the following description and the accompanying illustrative drawings.

DETAILED DESCRIPTION OF THE INVENTION

Figure 1:
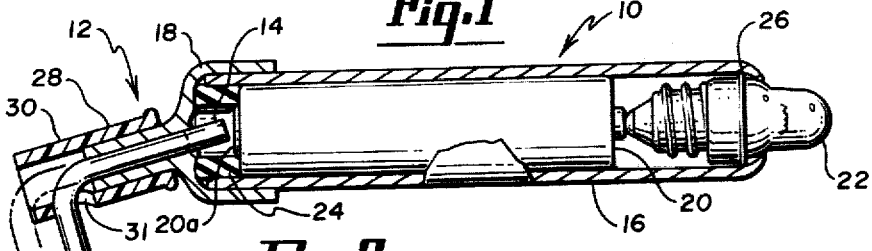
FIG. 1 is a side elevational view cutaway along the central axis showing one embodiment of the invention.

In FIG. 1, a first embodiment of the flashlight is shown. The flashlight is generally indicated at 10 and includes guide means generally indicated at 12 for mounting the flashlight. More specifically, means 12 comprises a combination mount and contact means by which a conductive contact member or insertable probe 14 may be used for removably and slidably mounting flashlight 10 in a substantially upright position in which a bulb 22 is turned "on", as will be discussed in more detail hereinbelow.

Flashlight 10 includes a housing 16, usually a metal tubular body which is electrically conductive. There is a closure member 18, usually an end-cap, which is electrically conductive and in contact with housing 16. Battery 20 is carried inside housing 16 in contact and cooperation with bulb 22 for energizing or illuminating the same when an electrical circuit is completed between the bulb and battery. Battery 20 is insulated from housing 16 by means of the typical battery wrapping. However, the normally exposed end **20*a* of battery 20 is separated from closure member 18 by means of a rubber washer 24. The base 26 of bulb 22 contacts conductive housing 16** as shown in the Figures.

Consequently, in such an arrangement with base 26 of bulb 22 contacting housing 16 and housing 16 contacting closure member 18 and with battery 20 contacting bulb 22 but separated from housng 16 and closure member 18, an open circuit condition is presented by the flashlight under normal circumstances as shown in FIG. 1. That is, bulb 22 is not energized.

Closure member 18 includes as a portion of its structure a preferably integral combination guide and contact means generally designated at 12. In this embodiment, means 12 will take the form, as shown in FIG. 1, of a conduit extension 28 which provides access through closure member 18 to the exposed end **20*a* of battery 20. Consequently, the insertion of a conductive elongated object such as he tip of an insertable metal probe 14 into conduit 28 through closure member 18 and against battery end 20*a* will, when contact is also made between probe 14 and the inner walls of conduit 28, complete an electrical circuit throughout the flashlight and between battery 20 and bulb 22**, which will energize the bulb and cause it to be illuminated.

Combination guide and contact means 12 will extend outwardly from closure member 18 and away from battery end **20*a* preferably at an angle relative to the longitudinal axis of the flashlight. More preferably, the angle will be intermediate the longitudinal axis of the flashlight and a plane normal to the flashlight body as is shown in FIG. 1. Such an angular extension allows the device to be readily mounted and retained on probe 14**.

Figure 2:
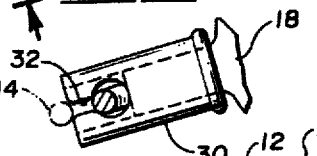
FIG. 2 is an auxiliary sectional view taken along lines 2—2 of FIG. 1.

As another means for retention, conduit extension 28 may be fitted, as shown, with a plastic sleeve 30 which includes a notch 31 having a narrowed entrance portion 32 (best seen in FIG. 2) for holding flashlight 10 on probe 14. Probe 14 may also be fitted with a suitable clamp 33 at its other end for mounting it and the flashlight to various objects for convenience and to avoid the need for holding the flashlight when illumination is desired.

As already indicated, flashlight 10 is slipped over the upright metal end of probe 14 with the tip of the probe contacting end **20*a* of battery 16 in order to energize bulb 22. As a consequence, the weight of flashlight 10 urges it downwardly on the conductive tip of probe 14 bringing the battery end 20*a* into contact with the tip, which as previously described is also in contact with the guide means and closure 18**, whereby the circuit is completed and the bulb of the flashlight is energized.

Figure 3:
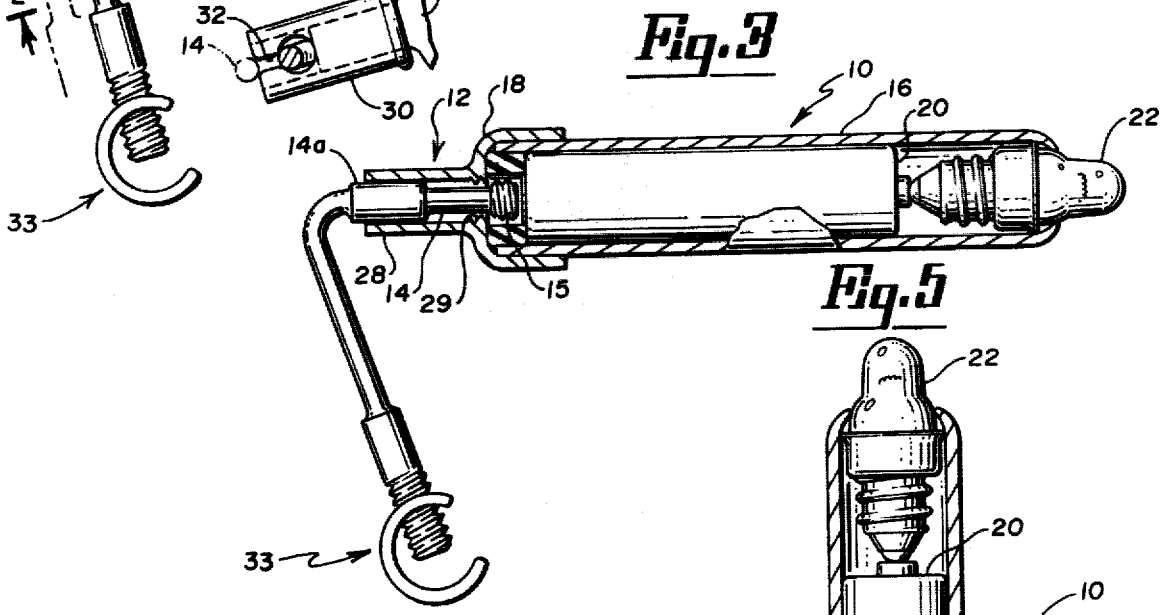
FIG. 3 is a side elevational view cutaway along the central axis showing a second embodiment of the invention.

Referring now to FIG. 3, there is shown a second embodiment of the invention wherein flashlight 10 includes substantially the same elements comprising housing 16, closure member 18, battery 20 and bulb 22 as previously described.

This embodiment also includes the combination guide and contact means 12 extending outwardly from closure member 18 and away from battery end **20*a*. However, in this embodiment, the combination guide and contact means 12 does not extend at an angle relative to the longutidinal axis of the flashlight. This is made possible by the modified design of the insertable metal probe 14 and the manner in which it cooperates with conduit 28**.

In this embodiment, probe 14 includes a threaded end portion 15, and conduit 28 is correspondingly threaded at 29, such that probe 14 may be inserted into the end of flashlight 10 by turning it past threads 29. Once tip 15 completely passes threads 29, probe 14 is free to move into and out of contact with the end of battery 20 but is still retained inside flashlight 10. Probe 14 may also include an enlarged portion **14*a* to provide a fit between probe 14 and the inside diameter of conduit 28 for steady support of flashlight 10 on probe 14**.

Figure 4:
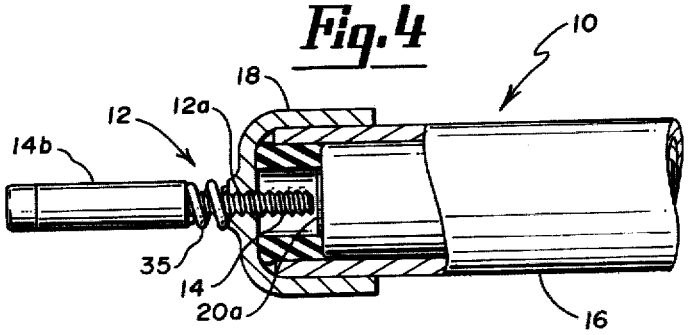
FIG. 4 is a partial side elevational view with parts cutaway of a third embodiment of the invention.

Referring now to FIG. 4, another embodiment of the invention is shown in which flashlight 10 includes the same basic elements as before. However, in this embodiment, the combination guide and contact means 12 and probe 14 are of another design.

In this embodiment, the combination guide and contact means 12 comprises a threaded portion 12*a* of end cap 18. Insertable contact probe 14 is correspondingly threaded and includes a grip member 14*b* and a lock spring 35, which aids in maintaining engagement between threaded probe 14 and end cap 18 and prevents the probe being inadvertently turned. In this embodiment, probe 14 may be turned so as to move into flashlight 10 and contact end 20*a* of battery 20 to complete the battery circuit and energize bulb 22.

Figure 5:
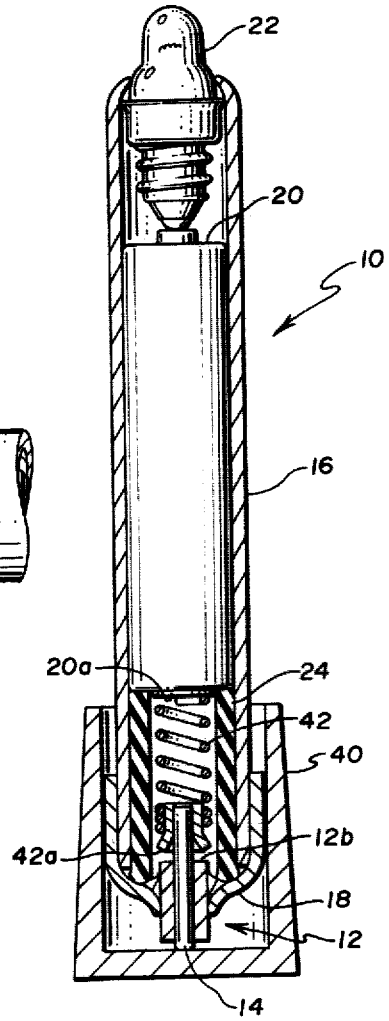
FIG. 5 is a side elevational section taken along the central axis of a fourth embodiment of the invention.

Referring now to FIG. 5, yet another embodiment of the invention is shown in which flashlight 10 again includes the same basic elements as before with the exception that probe 14 and combination guide and contact means 18 are of a modified design to provide a different mode of use and operation of the flashlight.

In this embodiment, the flashlight is designed to be de-energized when placed in an upright position in a receptacle 40, as shown in FIG. 5 and to be energized when removed therefrom.

In this embodiment, combination guide and contact means 12 provides an electrical contact surface 12*b*. A spring member 42 extends between end 20*a* of battery 20 and insertable probe member 14. Probe 14 is made of an insulating material such as plastic and is seated in contact member 42*a* at the end of spring 42.

When the flashlight is seated in receptacle 40 in the upright position as shown in FIG. 5, the weight of the flashlight bears against probe 14, causing it to move inwardly relative to flashlight 10, urging contact member 42*a* and spring 42 away from contact surface 12*b*. However, when the flashlight is removed from receptacle 40, spring 42 urges member 42*a* into contact with contact surface 12*b* thus energizing bulb 22.

The foregoing description is illustrative of several embodiments of the invention and the exclusive rights pertaining thereto are defined by the following claims.

I claim:

1. In a flashlight comprising:

a housing, at least a portion of which is electrically conductive;

a bulb electrically contacting the conductive portion of the housing;

a battery in the housing cooperating at one end thereof with the bulb;

a closure member at one end of the housing having at least a portion thereof electrically conductive and in contact with the conductive portion of the housing;

means electrically insulating the conductive portion of the closure member from the battery;

an electrically conductive contact member interposed in the housing between the closure member and the other end of the battery, said contact member being movable between a first position wherein said contact member is not simultaneously in contact with both the closure member and the battery, and a second position wherein said contact member is in simultaneous contact with both the closure member and the other end of the battery;

contact guide means providing access for the contact member through the closure member to the end of the battery, at least a portion of said contact guide means being electrically conductive and in contact with the closure member, and wherein said contact member is an electrically conductive reciprocating contact probe extending into the ousing through the contact guide means to simultaneously contact the battery and the contact guide means thereby completing an electrical circuit between the bulb and the battery to energize the bulb;

the improvement wherein:

the contact guide means comprises an electrically conductive portion of said closure member and defines an opening, the inside diameter of which is threaded, an end portion of the contact probe being correspondingly threaded such that end portion of the contact probe upon insertion into the contact guide means may be turned past the threaded portion thereof to position the threaded end portion of the probe in the housing free of the contact guide means threads whereupon the probe is received by the contact guide means and is free for reciprocal movement therein, the positioning of the threaded end portion of the contact probe in the housing past the contact guide means threads prohibiting the accidental removal of the contact probe from the flashlight upon reciprocation of the probe.

* * * * *